United States Patent [19]

Mok et al.

[11] Patent Number: 4,868,575

[45] Date of Patent: Sep. 19, 1989

[54] PHASE SLOPE EQUALIZER FOR SATELLITE ANTENNAS

[76] Inventors: Chuck K. Mok, 419 Halford Road, Beaconsfield, Quebec; Alain Martin, 46 St. Michel, Vaudreuil, Quebec; Christian Hobden, 4090 Northcliffe, Montreal, Quebec; Yves Patenaude, 5715 Dudemaine, Apt. 304, Montreal, Quebec, all of Canada

[21] Appl. No.: 126,844

[22] Filed: Nov. 30, 1987

[30] Foreign Application Priority Data

Dec. 4, 1986 [CA] Canada ..... 524489

[51] Int. Cl.[4] ..... H01P 7/06

[52] U.S. Cl. ..... 342/373; 333/232; 343/778

[58] Field of Search ..... 342/373; 343/778, 767, 343/777, 768; 333/232, 227, 228, 233, 28 R, 156, 212, 251, 263, 209, 231, 35, 157

[56] References Cited

U.S. PATENT DOCUMENTS

| | | | |
|---|---|---|---|
| 2,905,940 | 9/1959 | Spencer et al. . | |
| 2,956,247 | 10/1960 | Sferrazza | 333/31 |
| 3,153,208 | 10/1964 | Riblet . | |
| 3,353,122 | 11/1967 | Manoochehri . | |
| 3,421,118 | 1/1969 | Engelbrecht . | |
| 3,579,153 | 5/1971 | Han-Chiu Wang | 333/73 |
| 3,900,806 | 8/1975 | Caroli . | |
| 4,633,258 | 12/1986 | Mok et al. . | |

FOREIGN PATENT DOCUMENTS 158606 10/1985 European Pat. Off. .

3208029 3/1982 Fed. Rep. of Germany .

OTHER PUBLICATIONS

JPO Abstract #50-79681, Suga, 6/75.

IEEE Transactions on μwave Theory and Techniques 4/67 Characteristics of Waveguide Resonant Iris Filters.

G. L. Matthaei et al. "Microwave Filters, Impedance-Matching Networks, and Coupling Structures", 1964, McGraw-Hill Book Co., New York, U.S.-pp. 25, 423, 595, 596, 599, 600, 601, 605, 609, 701, 726, 727, 746, 755, 758, 862, 765, 766, 838, 839, 995.

*Primary Examiner*—Thomas H. Tarcza
*Assistant Examiner*—David Cain
*Attorney, Agent, or Firm*—Brooks, Haidt, Haffner & Delahunty

[57] ABSTRACT

A phase slope equalizer is a recent device used to replace phase shifters in feed networks for satellite communications antennas. The phase slope equalizer has been further refined so that, once manufactured, it does not require tuning and is well suited to integration in larger systems. Three main embodiments are disclosed, one based on a waveguide configuration and the other two on a square coaxial configuration. In the case of the waveguide configuration half wavelength short-circuited stubs spaced by a quarter wavelength are used and in the case of one of the square coaxial configurations half wavelength open-circuited stubs spaced by a quarter wavelength are used. The third embodiment uses quarter wavelength short-circuited stubs spaced by a quarter wavelength.

25 Claims, 2 Drawing Sheets

PHASE SLOPE EQUALIZER FOR SATELLITE ANTENNAS

BACKGROUND OF THE INVENTION

This invention relates to antenna feed networks and, in particular, feed networks for satellite antennas.

Typically, a satellite antenna comprises a cluster or array of individual horns positioned to direct individual radio frequency beams onto a reflector which redirects a combined beam to the desired coverage area of the earth.

The feed network for the satellite antenna comprises a transmit network, a receive network similar in construction and operation to the transmit network, and a duplexer (also known as a diplexer) array which is simply a means for allowing the transmit and receive networks to share the same array of horns.

Within the transmit (or receive) network is a plurality of couplers which distribute power among the horns in a prescribed manner. Also included in each transmit (or receive) network is a plurality of phase shifters. By varying the line lengths appropriately and by selecting appropriate phase shifters the desired phase relationship among the horns may be achieved.

The phase shifters used are of two types, capacitive and inductive. These give respectively negative and positive phase offsets. The phase offset however varies with frequency. Thus, if a 90° phase difference is required between two lines, a single 90° phase shifter placed in one of the lines will give the correct phase relationship at one frequency only, say at midband; there will be an error at the bandedges. To avoid this error, it is necessary to use a +45° phase shifter in one line and a −45° phase shifter in the other. The two phase shifters, although having differing signs, both have the same phase slope. That is, a capacitive phase shifter having numerically the same phase offset at midband as that of an inductive phase shifter, will also have the same algebraic slope. Thus, a constant phase differential is maintained over a finite bandwidth. In a typical feed therefore, combinations of different capacitive and inductive phase shifters are used throughout.

A typical antenna at K-band may have more than a hundred phase shifters. Because of this large quantity, any simplification in design and/or reduction in size can translate to appreciable savings in cost, volume and weight. To that end, a new component called a phase slope equalizer was developed recently and is the subject of U.S. Pat. No. 4,633,258 issued on Dec. 30, 1986 in the name of Spar Aerospace Limited.

The new phase slope equalizer described in the above identified patent has zero phase offset at midband but has a substantially constant phase slope across the bandwidth.

Phase correction therefore becomes relatively simple. The path lengths of the various feed lines are arranged to give the required phase offsets at midband only and then phase slope equalizers (one per line) are introduced to equalize the slopes among the lines. The slopes of all these equalizers have the same sign. This new approach dispenses with the inductive and capacitive phase shifters.

The advantages of the phase slope equalizer over the phase shifter approach are that the phase slope equalizer is smaller, simpler, less expensive and eases the problem of phase correction. Additionally, fewer phase slope equalizers are required; approximately half the number.

Although the concept of a phase slope equalizer has proved to be an extremely valuable one and has, in practice, given rise to the advantages indicated above, the specific embodiments described in the above identified application were designed as discrete components which require tuning. As antenna technology evolves, a trend towards the use of integrated waveguide at K-band (0.834 cm–2.75 cm) and integrated feed, realized with TEM-line (square coax.) at C-band (3.7 cm–5.1 cm) has become evident and component design has to be compatible with that concept. Key features are that the design be amenable to fabrication as part of an integral assembly and that the design require minimum or no tuning.

SUMMARY OF THE INVENTION

It is an object of the present invention to derive a phase slope equalizer which achieves these features.

According to a first broad aspect of the present invention, there is provided a phase slope equalizer comprising a rectangular waveguide section containing a resonant circuit which has a substantially constant slope phase shift/frequency response curve extending from a positive phase shift through zero phase shift in the region of the midband frequency to a negative phase shift, the waveguide section comprising a main waveguide and a number of short-circuited stubs, preferably between two and eight, in series connection to the main waveguide, the stubs having a nominal length any multiple of half wavelength at midband and the nominal spacing between the stubs being any odd multiple of quarter wavelength at midband.

According to a second broad aspect of the present invention, there is provided a phase slope equalizer containing a resonant circuit which has a substantially constant slope phase shift/frequency response curve extending from a positive phase shift through zero phase shift in the region of the midband frequency to a negative phase shift, the phase slope equalizer being formed as a coaxial conductor, preferably a rectangular coaxial conductor, comprising a main conductor and one or more open-circuited stubs in shunt connection to the main conductor, the stubs having a nominal length any multiple of half wavelength at midland and the nominal spacing between the stubs being any odd multiple of quarter wavelength at midband.

According to a third broad aspect of the present invention, there is provided a phase slope equalizer which has a substantially constant slope phase shift/frequency response curve extending from a positive phase shift through zero phase shift in the region of the midband frequency to a negative phase shift, the phase slope equalizer being formed as a coaxial conductor, preferably a rectangular coaxial conductor, comprising a main conductor and one or more short-circuited stubs in shunt connection to the main conductor, the stubs having a nominal length any odd multiple of quarter wavelength at midband and the nominal spacing between the stubs being any odd multiple of quarter wavelength at midband.

DESCRIPTION OF THE PREFERRED EMBODIMENTS

Figure 1:
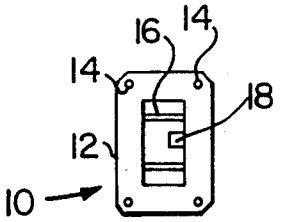
FIG. 1 is an end view of a 4-element phase slope equalizer of the type described in U.S. Pat. No. 4,633,258.
Figure 2:
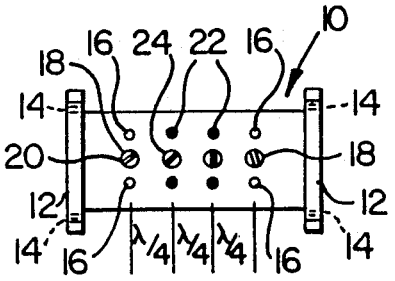
FIG. 2 is a front view of the phase slope equalizer of FIG. 1.

Referring firstly to FIGS. 1 and 2, representing one embodiment of phase slope equalizer described in U.S. Pat. No. 4,633,258, a 4-element device is formed of a rectangular waveguide 10 having two end flanges 12 containing holes 14 adapted to receive bolts (not shown) for connection to flanged portions of the waveguide line (not shown). The first element and the last element are identical, each comprising a pair of spaced posts 16 soldered to opposite inside faces of the waveguide and a tuning screw 18 received in a threaded hole (not shown) in one of the waveguide sides at a location intermediate the posts are parallel thereto. A portion of screw 18 extends outwardly of the waveguide and is provided with a slot 20 which may be engaged by a screwdriver for moving the screw further inwardly or outwardly to increase or decrease the capacitance as necessary for tuning purposes.

The second and third elements, spaced from each other and from the first and last elements by a quarter wavelength, each comprises a pair of spaced posts 22 of greater diameter than posts 16 to provide an inductance twice that of posts 22 and a tuning screw 24 of greater length than screws 18 to provide a capacitance twice that of screws 18.

Figure 8:
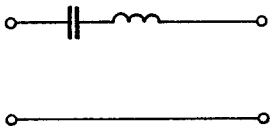
FIG. 8 is an equivalent electrical circuit diagram of the phase slope equalizer shown in FIGS. 1 and 2 and similar to the equivalent diagram of the device of FIGS. 5 and 6.
Figure 9:
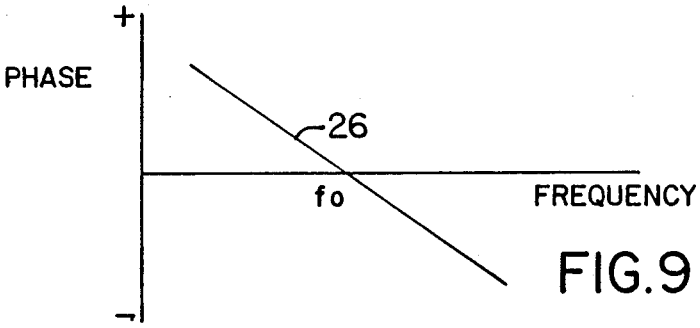
FIG. 9 is a graph of phase shift against frequency representing the typical response of the phase slope equalizers of FIGS. 1 and 2, 3 and 4 and 5 and 6.

FIG. 8 is a simplified equivalent diagram of one element of the phase slope equalizer of FIGS. 1 and 2. Essentially, the device operates as a shunt resonator comprising an inductance L representing the inductance of the posts 16 or 22 and a variable capacitor C representing the variable capacitance of the tuning screws 18 and 24. Below resonance the circuit is shunt inductive, giving a positive phase shift, while above resonance the circuit is shunt capacitive, giving a negative phase shift as illustrated in FIG. 9. At resonance, or midband, it is shunt open-circuit giving zero phase shift. It can be seen that the phase shift/frequency response curve 26 is essentially a straight line passing through the midband frequency $f_o$ at zero phase offset, the slope of the line being negative, substantially constant and a function of L and C.

Figure 3:
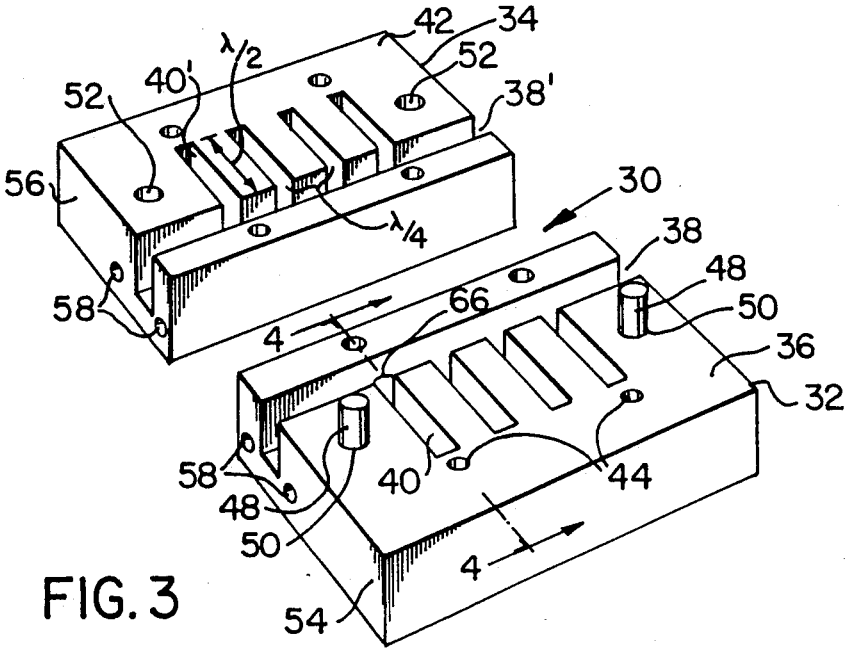
FIG. 3 is an unassembled perspective view of two halves of a K-band phase slope equalizer according to the invention.
Figure 4:
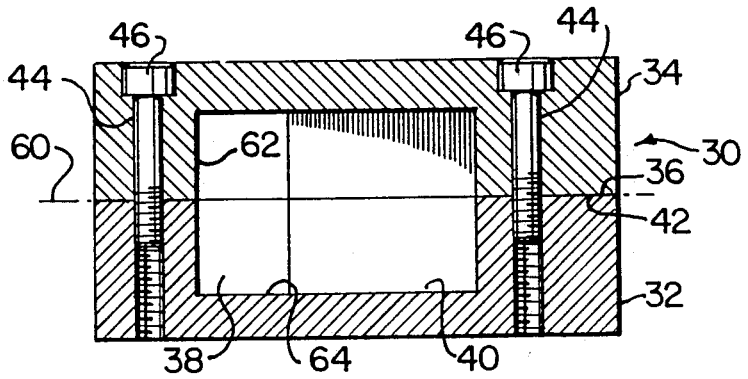
FIG. 4 is a transverse sectional view of the assembled phase slope equalizer of FIG. 3.

Referring now to FIGS. 3 and 4, this shows a K-band phase slope equalizer 30 constructed according to the principles of the present invention. It comprises two milled halves 32 and 34, made preferably of aluminum for lightness. Half 32 is provided on one face 36 with a pattern of a main waveguide channel 38 and four stub channels 40 extending from one side of main channel 38. Half 34 is provided on one face 42 with a pattern which is the mirror image of that on half 32, comprising a main waveguide channel 38′ and four stub channels 40′. When half 34 is inverted and placed on top of half 32, the main channels 38 and 38′ align to form a main waveguide and stub channels 40 and 40′ align to form stubs. The reference numerals 38 and 40 will be used hereinafter to refer to the complete waveguide and stubs, respectively, it being understood that the complete waveguide also incorporates portion 38′ and the complete stubs also incorporate portions 40′.

Numerous holes 44 extend completely through each half 32 and 34 opening onto sides 36 and 42, the holes in each half respectively registering with the holes in the other half. The holes may be threaded to receive screws 46 holding the two halves together or may be unthreaded and adapted to receive nuts and bolts for securing the two halves together. Guide means for ensuring the two halves are precisely aligned take the form of dowel pins 48 received in blind holes 50 on face 36 and adapted to register with blind holes 52 on face 42.

Also shown in the visible end surfaces 54 and 56 of the two halves 32 and 34 are blind holes 58 for mounting the phase slope equalizer to a waveguide flange or like adjoining portion of the feed line.

It can be seen that the assembled phase slope equalizer 30 comprises a main waveguide 38 and four short-circuited stubs 40 in series connection with the main waveguide. The stubs 40 are nominally each a half wavelength long and the spacing between the stubs is nominally a quarter wavelength but both that spacing and the length of the stubs would in practice be varied from their nominal values because of the well-known phenomenon of "junction effect". The stub lengths, instead of being a half wavelength long, could be any multiple of $\lambda/2$ and similarly, the stub spacing could be any odd multiple of $\lambda/4$. Moreover, although a four stub device is illustrated, fewer or more stubs, typically between two and eight, could be used.

An important aspect of the embodiment illustrated in FIGS. 3 and 4 is the fact that the joint between the two halves of the assembled device is in a plane, referenced 60 in FIG. 4, which bisects the broadwall 62 of the main waveguide 38. This is the preferred configuration since there is no transverse current component at the joint; i.e., electrically, the joint is of no consequence.

As can be seen from FIG. 4, the stub depth, i.e. dimension parallel to the main waveguide broadwall 62 is identical to the broadwall dimension, typically 0.75". The narrow wall 64 of the main waveguide is typically 0.2". The width of each stub, i.e., the dimension 66 across the stub (FIG. 3) in a direction parallel to the direction the main waveguide runs is in a range approximately 0.03" to approximately 0.15", the larger the value the larger the desired phase slope. Although in FIG. 4 all the stubs have the same width, it is sometimes preferable for wider band operation to have the first and the last stubs to be of nominally half the width of the inner stubs.

Figure 7:
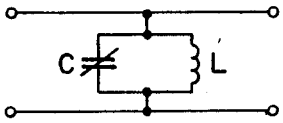
FIG. 7 is an equivalent electrical circuit diagram of the phase slope equalizer shown in FIGS. 3 and 4.

FIG. 7 is a simplified equivalent circuit diagram of one stub of the phase slope equalizer of FIGS. 3 and 4. Essentially, the device operates as a series L C resonator which is series capacitive below resonance, series inductive above resonance and again this gives a phase slope as illustrated in FIG. 9.

Figure 5:
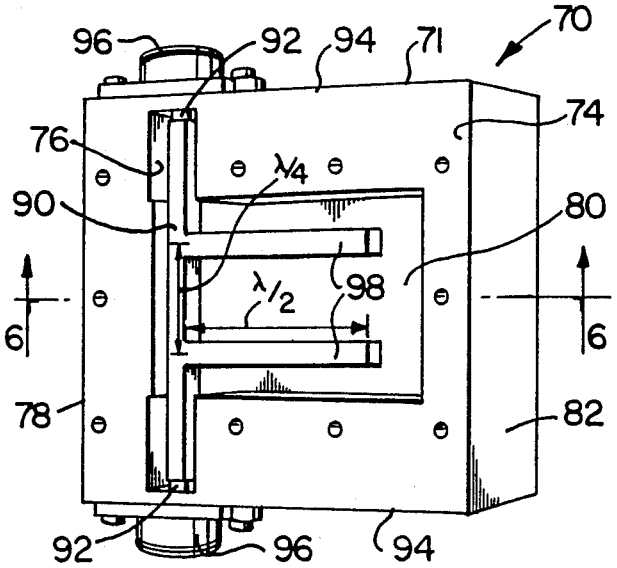
FIG. 5 is a perspective view of a C-band phase slope equalizer according to the invention, with the cover thereof removed to expose interior details.
Figure 6:
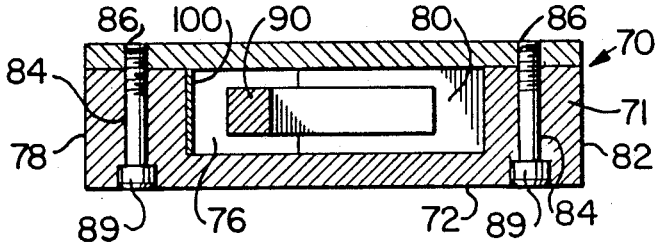
FIG. 6 is a transverse sectional view of the phase slope equalizer of FIG. 3.

Turning now to FIGS. 5 and 6, this shows a C-band phase slope equalizer 70 according to the invention. At C-band a waveguide type device would be too large and so a TEM (transverse electric-magnetic) line is preferred. TEM line is essentially a square or rectangular coaxial structure with both centre and outer conductors having square cross-section. The square or rectangular cross-section as opposed to circular cross-section permits the fabrication by milling of a complete assembly of components. Consequently, the phase slope equalizer 70 is made in this medium.

It should be understood that FIGS. 5 and 6 illustrate a "breadboard" configuration built for experimentation and testing purposes and, for that reason, it has been adapted for connection to round coaxial cable by means of connectors at both ends. In practice, however, the phase slope equalizer would be formed integrally with other components of an antenna feed system and the connectors would be dispensed with. This will be discussed in more detail below.

The phase slope equalizer 70 comprises a generally rectangular aluminum plate 71 which has a generally planar underside 72 and an upper side 74 machined with a main rectangular section channel 76 running parallel to and proximate one of the sides 78, and a rectangular cavity 80 extending over an intermediate portion of the main channel 76 and projecting towards the side 82 opposite side 78. The main channel and the cavity are the same depth, as can be seen in FIG. 6.

A plurality of spaced through holes 84 communicate with both sides 72 and 74 and are located to register with corresponding holes 86 on a cover 88. Suitable fastening means such as machine screws 89 extending through holes 84 and 86 are used to secure the cover 88 to the plate 71 of the phase slope equalizer.

A square section aluminum centre conductor 90 extends along the channel 76 equally spaced from all four sides of the channel opposite end portions of the conductor terminating in round section portions 92 which extend through respective apertures in end walls 94 of the phase slope equalizer plate 71. Secured to the end walls 94 and surrounding the end portions 92 of the conductor 90 are respective connectors 96 for connection of the phase slope equalizer to circular coaxial lines. The conductor 90 is held in place by means of grub screws (not shown) in connectors 96.

As alluded to above, connectors 96 would not be needed in a practical, i.e., production, embodiment. Conductor 90 would not have round section end portions 92, these being present in the "breadboard" version for use with the connectors, but would be square section along its entire length. In fact, the phase slope equalizer would be integrated with a diplexer at one end and a coupler at the other, with the centre conductor extending continuously into the diplexer and coupler. U-shaped dielectric spacers (instead of grub screws) are used in the production embodiment to hold conductor 90 in place, these spacers being situated at various locations in channel 76, as extended through the diplexer and coupler.

Two spaced aluminum conductors 98 extend laterally from conductor 90 into cavity 80 and towards side 82. These conductors 98 act as open-circuited stubs connected in parallel or shunt with main conductor 90. The stubs are a half wavelength long and are spaced a quarter wavelength apart but the length could be any multiple of $\lambda/2$ and the spacing any odd multiple of $\lambda/4$. Although two stubs are shown, an embodiment using one stub or more than two is feasible.

To compensate for the effect of the cavity 80 on the main conductor 90, the channel 76 is narrowed along a portion adjacent the cavity 80 by means of a thickened wall portion 100 opposite the cavity and coextensive with the cavity.

The equivalent circuit of each stub of the phase slope equalizer 70 is that shown in FIG. 8 except that the capacitance is not normally variable and the phase versus frequency characteristic is that shown in FIG. 9.

Typical dimensions for the parts of the phase slope equalizer shown in FIGS. 5 and 6 for operation at 6 GHz are as follows. The length of the stubs is 0.9" to 1.0", i.e., approximately $\lambda/2$, and the stub spacing is approximately 0.47". The stub depth is 0.154", the same as that of centre conductor 90, and the stub width is in the range of 0.03" to 0.154", the greater this dimension the greater the slope of the phase/frequency characteristic. The centre conductor 90 is 0.154" by 0.154" in section and channel 76 is 0.384" by 0.384" before and after the location of cavity 80. The thickened wall portion 100 extends into channel 76 by about 0.04".

The dimensions of cavity 80 are not critical. The length in the direction parallel to the stubs may be approximately 1.03" and the length parallel to channel 76 may be approximately 0.95". The depth of the cavity is, as explained above, the same as that of channel 76, namely 0.384".

In a modified version of the C-band phase slope equalizer of the type shown in FIGS. 5 and 6, instead of the stubs being open-circuited, they are short-circuited. This can be carried out by raising the floor of cavity 80 near the free ends of the stubs such that the free ends are in contact with the cavity floor and are thereby short-circuited. Another difference over the FIG. 5 version is that the stubs are $\lambda/4$ long instead of $\lambda/2$. The $\lambda/4$ length is, of course, the distance to the point where the stub engages the floor of the cavity. Typically, this distance is 0.5" with an additional 0.1" at the free end of the stub engaging the cavity floor. The stub spacing is again nominally $\lambda/4$.

It should be noted that for this short-circuited version, the phase slope achieved would be half that obtained for the open-circuited version of FIG. 5, assuming the same stub width.

The phase slope equalizers described in relation to FIGS. 5 and 6 and the short-circuited modification thereof employ a square, or possibly, rectangular configuration but it is envisaged that a circular coax. configuration (with rectangular cavity 80) would be feasible but, clearly, manufacture would be more complicated.

All of the phase slope equalizers described thus far employ stubs emanating from one side only but the stubs could emanate from both sides. However, such "double-sided" configuration is not preferred because it virtually doubles the width of the device.

The advantages of the K-band and C-band phase slope equalizers described above are, firstly, that they are dimensionally tolerant and therefore need no tuning and, secondly, they can easily be fabricated as part of a larger assembly of integrated waveguide components or TEM line feeds as the case may be.

What we claim as our invention is:

1. A phase slope equalizer comprising a rectangular waveguide section containing a resonant circuit which has a substantially constant slope phase shift/frequency response curve extending from a positive phase shift through zero phase shift in the region of the midband frequency to a negative phase shift, the waveguide section comprising a main waveguide and a number of short-circuited stubs in series connection to the main waveguide, the stubs having a nominal length any multiple of half wavelength at midband and the nominal spacing between the stubs being any odd multiple of quarter wavelength at midband.

2. A phase slope equalizer according to claim 1 wherein the stubs have a nominal length of a half wavelength at midband and a nominal spacing of a quarter wavelength at midband.

3. A phase slope equalizer according to claim 1 in which the waveguide section is formed by two mutually mirror image halves, each half including a half of the main waveguide and a half of each stub and further comprising means for securing the two halves together, whereby the joint between the two halves bisects the broadwall of the main waveguide.

4. A phase slope equalizer according to claim 3 in which the means for securing the two halves together comprises through holes and fastening members passing through the through holes.

5. A phase slope equalizer according to claim 4 including blind holes in mating faces of the two halves and dowell pins received in the blind holes.

6. A phase slope equalizer according to claim 1, 2 or 3, manufactured of aluminum.

7. A phase slope equalizer according to claim 1, 2 or 3, in which the broadwall dimension of the main waveguide is approximately 0.75", the narrow wall dimension is approximately 0.2" and the width of each stub is in the range approximately 0.03" to approximately 0.15".

8. A phase slope equalizer according to claim 1, 2 or 3, wherein the stubs all extend from one side of the main waveguide.

9. A phase slope equalizer comprising a rectangular waveguide section containing a resonant circuit which has a substantially constant slope phase shift/frequency response curve extending from a positive phase shift through zero phase shift in the region of the midband frequency to a negative phase shift, the waveguide section comprising a main waveguide and between 2 and 8short-circuited stubs in series connection to the main waveguide, the stubs having a nominal length any multiple of half wavelength at midband and the nominal spacing between the stubs being any odd multiple of quarter wavelength at midband.

10. A phase slope equalizer according to claim 9 wherein the stubs have a nominal length of a half wavelength at midband and a nominal spacing of a quarter wavelength at midband.

11. A phase slope equalizer according to claim 9 in which the waveguide section is formed by two mutually mirror image halves, each half including a half of the main waveguide and a half of each stub and further comprising means for securing the two halves together, whereby the joint between the two halves bisects the broadwall of the main waveguide.

12. A phase slope equalizer according to claim 11 in which the means for securing the two halves together comprises through holes and fastening members passing through the through holes.

13. A phase slope equalizer according to claim 12 including blind holes in mating faces of the two halves and dowell pins received in the blind holes.

14. A phase slope equalizer according to claim 9, 10 or 11, manufactured of aluminum.

15. A phase slope equalizer according to claim 9, 10 or 11, in which the broadwall dimension of the main waveguide is approximately 0.75", the narrow wall dimension is approximately 0.2" and the width of each stub is in the range approximately 0.03" to approximately 0.15".

16. A phase slope equalizer according to claim 9, 10 or 11, wherein the stubs all extend from one side of the main waveguide.

17. A phase slope equalizer according to claim 9, 10 or 11, wherein the width of the two outer stubs is nominally half the width of the inner stubs.

18. A phase slope equalizer containing a resonant circuit which has a substantially constant slope phase shift/frequency response curve extending from a positive phase shift through zero phase shift in the region of the midband frequency to a negative phase shift, the phase slope equalizer being formed as a rectangular coaxial conductor comprising a body portion serving as an outer conductor and having a rectangular channel along which extends coaxially a rectangular main conductor, the body portion also having a rectangular cavity communicating with the channel and receiving in spaced relation to the body one or more rectangular open-circuited stubs in shunt connection to the main conductor, the stubs having a nominal length any multiple of half wavelength at midband and the nominal spacing between the stubs being any odd multiple of quarter wavelength at midband.

19. A phase slope equalizer according to claim 18 in which the channel is narrowed along a portion substantially coextensive with the cavity by means of a thickened wall portion opposite the cavity.

20. A phase slope equalizer according to claim 18 or 19, manufactured of aluminum.

21. A phase slope equalizer according to claim 18 or 19, wherein the stubs all extend from one side of the main conductor.

22. A phase slope equalizer containing a resonant circuit which has a substantially constant slope phase shift/frequency response curve extending from a positive phase shift through zero phase shift in the region of the midband frequency to a negative phase shift, the phase slope equalizer being formed as a rectangular coaxial conductor comprising a body portion serving as an outer conductor and having a rectangular channel along which extends coaxially a rectangular main conductor, the body portion also having a rectangular cavity communicating with the channel and receiving in spaced relation to the body one or more rectangular short-circuited stubs in shunt connection to the main conductor, the stubs having a nominal length any odd multiple of quarter wavelength at midband and the nominal spacing between the stubs being any odd multiple of quarter wavelength at midband.

23. A phase slope equalizer according to claim 22, in which the channel is narrowed along a portion substantially coextensive with the cavity by means of a thickend wall portion opposite the cavity.

24. A phase slope equalizer according to claim 22 or 23, manufactured of aluminum.

25. A phase slope equalizer according to claim 22 or 23, wherein the stubs all extend from one side of the main conductor.

* * * * *